US007367276B2

(12) United States Patent
Ashdown

(10) Patent No.: US 7,367,276 B2
(45) Date of Patent: May 6, 2008

(54) RETRACTABLE BOWSPRIT FOR SAILBOAT

(76) Inventor: Glynn Russell Ashdown, 2S720 Williamsburg Ct., Oak Brook, IL (US) 60523

( * ) Notice: Subject to any disclaimer, the term of this patent is extended or adjusted under 35 U.S.C. 154(b) by 173 days.

(21) Appl. No.: 11/172,673

(22) Filed: Jul. 1, 2005

(65) Prior Publication Data

US 2007/0000420 A1 Jan. 4, 2007

(51) Int. Cl.
*B63B 15/00* (2006.01)

(52) U.S. Cl. ..... 114/89

(58) Field of Classification Search ..... 114/89, 114/102.1, 102.28, 102.3, 97, 98
See application file for complete search history.

(56) References Cited

U.S. PATENT DOCUMENTS

| | | | | |
|---|---|---|---|---|
| 4,164,193 | A | 8/1979 | Smith | |
| 4,515,100 | A * | 5/1985 | Grierson | 114/97 |
| 4,539,927 | A * | 9/1985 | Foresman | 114/89 |
| 4,598,658 | A | 7/1986 | Eglais | |
| 5,333,566 | A | 8/1994 | Wasowski, Jr. | |
| 5,765,498 | A | 6/1998 | Hammarstedt | |
| 6,148,753 | A | 11/2000 | Shore | |
| 6,647,917 | B1 | 11/2003 | Hoyt | |
| 6,857,380 | B1 | 2/2005 | Robinson | |

OTHER PUBLICATIONS

Bow sprit—Harris & Ellis Yachts / Bow sprit Cameron McTavish Mar. 17, 2005 p. 1 of 1.

* cited by examiner

*Primary Examiner*—Ed Swinehart
(74) *Attorney, Agent, or Firm*—Schiff Hardin LLP

(57) ABSTRACT

A bowsprit, or spar, for supporting a spinnaker sail at the front of a sailboat is mounted on the deck of the sailboat. The bowsprit is retractable and extendable in telescoping fashion and includes a rope or tack line extending from the forward end thereof that connects to the corner or tack of the spinnaker sail. The aft or back end of the bowsprit is clipped to the mast and may be unclipped therefrom and secured to the deck so as to position the bowsprit at an angle to the boat to present the spinnaker sail to the wind. The present bowsprit is mounted along the midline of the boat and extends through a swivel bridle that connects the forestay to the deck. Extension of the bowsprit is accomplished by pulling a line connected to the inner pole of the bowsprit and passing around a pulley so that the inner pole slides out to an extended position from the outer sleeve of the bowsprit.

14 Claims, 6 Drawing Sheets

RETRACTABLE BOWSPRIT FOR SAILBOAT

BACKGROUND OF THE INVENTION

1. Field of the Invention

The present invention relates generally to a bowsprit or spar projecting from the bow of a sailing vessel and in particular to a retractable bowsprit for supporting a spinnaker sail or other headsail.

2. Description of the Related Art

A sailboats sails are deployed to catch the wind and provide the force for moving the boat through the water. Various sails are employed on a sailboat for different sailing conditions and different sailing directions. When sailing with the wind, or downwind, a large sail called a spinnaker may be deployed to catch the wind. The spinnaker is a sail commonly deployed off the front of the boat during downwind sailing. The spinnaker may be supported by a spinnaker pole which is a structure that is attached to the mast and used for the purpose of supporting and positioning the tack of the spinnaker in a substantially horizontal manner away from the mast. A traditional bowsprit is a structure extending from the front of the stem or bow of the boat which is used to support the tack of a jib or other headsails.

In modern sailing craft, where a bowsprit is provided, it is usually of a retractable design and mounted within the hull of the craft and extends through an opening below and to one side of the bow from which it can be extended.

Normally, a sailboat has a mainsail which is a triangular sail extending behind the mast. The mast is a spar or relatively rigid elongated pole that supports a sail in some way and is mounted extending vertically from the deck. In sloop-rigged sailboats or sloops, a triangular jib sail is also supported by the mast at the head or top most corner of the triangle. Sailboats cannot sail directly into the wind, but typically have the ability to sail within 50° or less of the true wind direction. Sailing as close to the wind as is possible is referred to as beating. Therefore, sailboats must keep tacking (changing sailing direction) when beating and end up sailing a zigzag route to a reach any point directly upwind from the starting point.

As noted, some sailboats have a bowsprit, which is a type of spar extending forward from the bow to which a jib or other headsail is attached. Many sailboats are also rigged to carry spinnakers, which are large sails for running, or sailing downwind, and reaching. Reaching refers to sailing at angles to the true wind between beating and running, or approximately from 50° to 160° from the true wind.

Spinnakers are sails that typically have an isosceles triangle shape with somewhat rounded sides. A spinnaker is stowed when a sailboat is beating and then lifted with a spinnaker halyard to place the head of the spinnaker at or near the top of the mast when reaching and running. Spinnakers have one of the lower corners attached to a forward end of a spinnaker pole. Conventionally, the aft or rear most end of the spinnaker pole is attached to the front of the mast. As shown in FIG. 11, a spinnaker carried on a spinnaker pole mounted on a mast is normally symmetrical in that lengths of the sail's port and starboard edges are equal. When the spinnaker is stowed, the spinnaker pole is either lowered to the deck or removed from the mast and stowed on the side deck.

In many newer designs, the spinnaker pole is replaced by a bowsprit which is mounted so as to project from the bow of the sailboat. This can usually be retracted along a generally horizontal path into the hull when the sailboat is not carrying the spinnaker so that the bowsprit is not left projecting from the bow where it could be damaged in a collision and may represent a potential danger to the crew of other boats crossing the bow.

As shown in FIG. 12, a spinnaker carried on a retractable bowsprit is typically asymmetrical, meaning that the triangular sail shape is scalene rather than the generally isosceles shape of a conventional spinnaker. The asymmetric spinnaker is similar to a genoa sail, but larger and with a fuller and more rounded shape. The longest edge of an asymmetrical spinnaker is typically connected between the forward end of the bowsprit and the top, or a location near the top, of the mast. The other vertical edge of an asymmetrical spinnaker is trimmed with a spinnaker sheet to a leeward point on the boat hull similar to that of a conventional spinnaker.

Although an asymmetrical spinnaker does not permit sailing an angle as "deep" or downwind as a symmetrical spinnaker design, it has the advantage of allowing faster reaching speeds than possible with symmetrical spinnaker or even with a large genoa sail. Some sailboats can sail more rapidly to a particular downwind point by reaching for a time on one jibe (or direction), and then jibing to a reach on the opposite jibe rather than by running directly downwind. Jibing refers to steering the sailboat stern through the wind from one tack to the other while sailing downwind.

Recently it has become a normal industry practice to add a bowsprit in favor of the previously common spinnaker pole. This is because of the simplicity of jibing an asymmetrical spinnaker mounted on a bowsprit, when compared with jibing a conventional symmetrical spinnaker mounted on the spinnaker pole projecting from either the port or starboard side of the mast.

Jibing a symmetrical spinnaker is difficult because the symmetrical spinnaker pole mounted on the mast must be transferred from one side of the boat to the other during a jibe. Because the spinnaker pole projects beyond the forestay of the boat, the outboard end of the pole must be detached from the tack of the sail and then reattached once the pole is moved to the opposite side of the boat. This jibing maneuver is usually accomplished by using a so-called "dip pole" jibe in larger boats, or sometimes an "end-over-end" jibe in smaller boats.

This jibing task is one of the most difficult tasks in all sailing maneuvers, especially in higher winds, and can result in the crew losing control of the boat. The spinnaker often collapses during the jibe maneuver and in high winds may even wrap itself around the forestay resulting in a very hazardous situation for the crew. Although experienced racing crews are skilled in carrying out this downwind jibing maneuver, things can go wrong during spinnaker jibes even at the highest of crew skill levels, such as in America's Cup racing.

As a result of the complexity of jibing symmetrical spinnakers mounted on spinnaker poles and the resulting requirement of high crew skill levels, many new boat designs have moved away from this in favor of the asymmetrical spinnaker mounted on an extendable bowsprit. Jibing an asymmetrical spinnaker is a much simpler maneuver because the bowsprit remains fixed in position and attached to the sail throughout the jibe, and is only marginally more difficult than jibing the much smaller jib sail.

U.S. Pat. No. 6,857,380 discloses a retractable bowsprit for a sailboat suitable for use with an asymmetrical spinnaker. A support element and a bowsprit positioner are track mounted within the hull of the sailboat to allow the bowsprit to assume either an extended or retracted position. The bowsprit positioner is mounted to the bottom of the hull. This U.S. Pat. No. 6,857,380 is incorporated herein by reference.

Such a retractable bowsprit is usually mounted to one side (usually on the starboard side) of the boat under the foredeck and at a slight angle to the fore and aft centerline of the boat. The pole is mounted in such a way that, when extended, the outboard end of the pole is exactly along the centerline of the boat and directly in front of the bow. This is done to avoid mounting the pole directly down the centerline of the boat underneath the foredeck.

Retractable bowsprits are rarely mounted along the centerline, particularly in larger craft, because such a mounting position would likely interfere with access to the interior of the forepeak or V berth, and also block access to any hatch mounted in the center of the foredeck. By mounting the pole against the side of the boat, and angling the pole with this method, the same position is achieved as if the pole was mounted down the centerline of the boat, and therefore the tack of the spinnaker is always at the centerline of the boat whether sailing on the starboard or port jibe.

However, there are significant disadvantages to this industry practice of a below-deck offset bowsprit mounting arrangement that the present retractable bowsprit invention seeks to eliminate. Firstly, and perhaps most importantly, mounting the retractable bowsprit below the deck requires a relatively large aperture to be created through the hull near the bow, in one of the worst possible positions where it is constantly receiving waves and spray when underway. This aperture is difficult, if not impossible, to completely seal and therefore may allow at least small amounts of water to enter the boat. Water can travel through the aperture in the bow then along the internal bowsprit sleeve and into the forepeak section of the boat. During long periods underway, and even when the spinnaker is not in use, water taken inboard through the aperture could build up and represents a "silent" and arguably unnecessary additional safety hazard to the boat and crew.

Secondly, mounting the retractable bowsprit offset inside the forepeak makes the hull more complex and expensive to produce. The production molds used to produce the hull must also be more complex and non-symmetrical along the centerline, increasing manufacturing costs.

Thirdly, the retraction mechanism for these bowsprits is often difficult for the user to access. Should something fail with the retraction mechanism, it may not be possible for the crew to correct the fault underway. In large sailboats with V berths, the mechanism maybe concealed behind fixed panels. In small sailboats with little or no interior space, the mechanism may be inaccessible, or may require a crew member to crawl forward into an unlighted and narrow space between the deck and hull to gain access to the mechanism.

SUMMARY OF THE INVENTION

The present invention relates generally to a bowsprit that is mounted above the deck to eliminate the significant disadvantages of a below-deck bowsprit described above, but which is also extendable off the bow of a sailing vessel to support an asymmetrical spinnaker sail. The bowsprit of the present invention is retractable to an inboard position, and when deployed can be also be mounted at angles relatives to the midline of the sailboat to enable deployment of the asymmetrical spinnaker sail at differing angles to the direction of travel. This adjustable angle of the bowsprit permits a boat to sail at a deeper angle than is normally possible with existing retractable bowsprit and asymmetrical spinnaker arrangements.

Furthermore, the retractable bowsprit of this invention is largely independent of a boat's hull, deck and mast, and with minor hardware additions or changes, may easily be added to existing boats. Therefore, the retractable bowsprit of this invention may be desirable to sailboat owners wishing to add such a bowsprit to a boat having no spinnaker mounting arrangement, or who are desirous of replacing an existing, but difficult to handle, symmetrical spinnaker pole arrangement without expensive modifications to the existing boat.

In addition, the bowsprit of the current invention eliminates a sailboat design conflict that has hitherto precluded the use of an above-deck extendable bowsprit design. Any such design for an above deck bowsprit arrangement must resolve the design conflict of needing the bowsprit to somehow pass through the obstacle of the forestay required to support the mast. The forestay is attached to a fixing at the center line of the deck at the bow of the boat, and therefore directly blocking the path of any centrally mounted above deck bowsprit. Therefore, any above deck bowsprit arrangement must be mounted to either side of the forestay or, as with this invention, incorporate an arrangement to in some way pass directly through it.

Any scheme mounted to the side of the forestay will have at least the same jibing difficulties previously noted with conventional spinnaker poles mounted on masts. In other words, the sail's tack (or corner) will require detachment from and subsequent reattachment to the pole in order to pass to the other side of the boat during a jibe, and therefore offers no advantage, and several other possible disadvantages, when compared with existing arrangements.

As will become apparent in the following detailed description, the current invention creates a simple bridle arrangement that permits the bowsprit pole to pass directly through the line of the forestay wire without having any impact on its ability to support the mast.

DETAILED DESCRIPTION OF THE PREFERRED EMBODIMENTS

Figure 1:
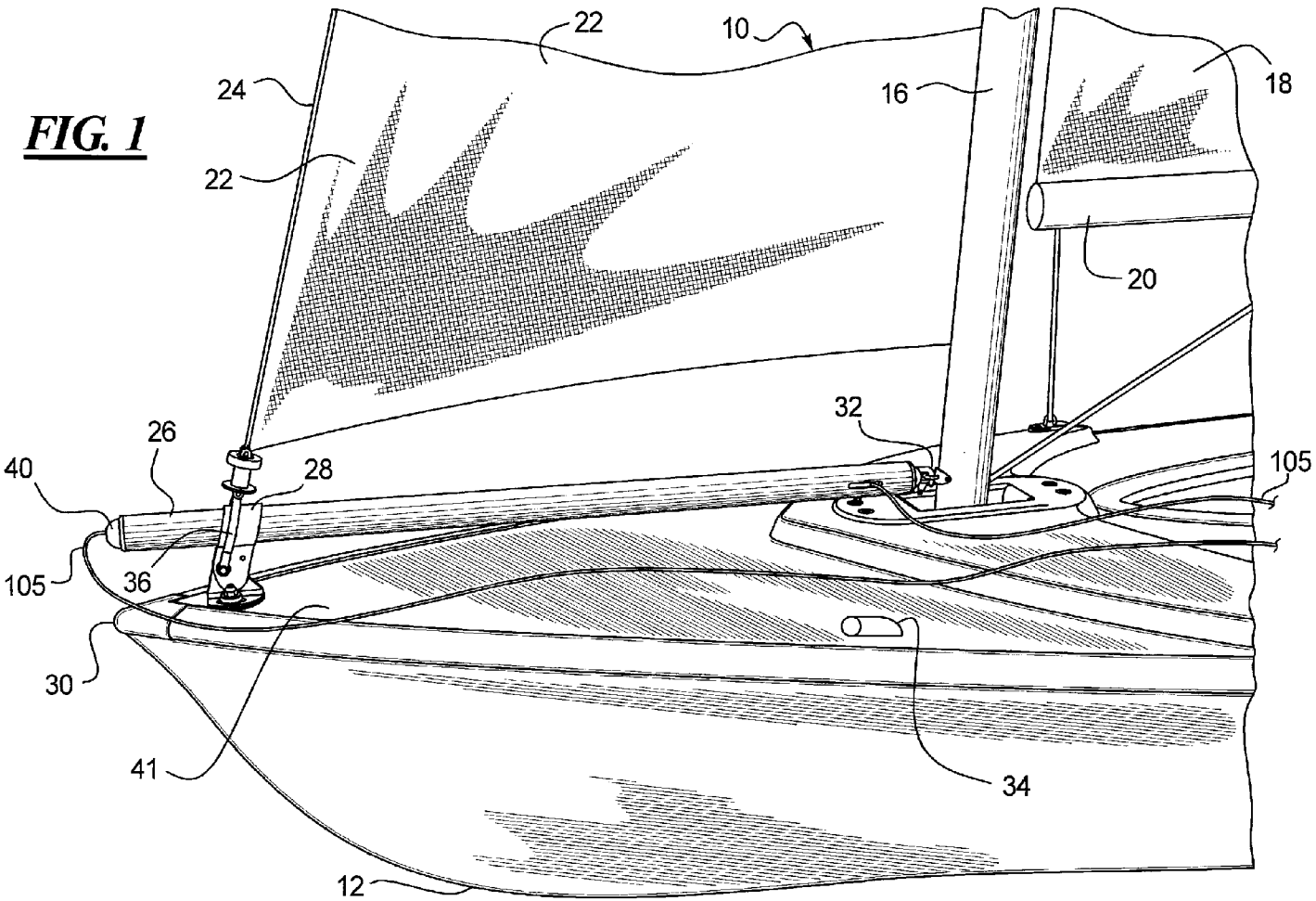
FIG. 1 is a side perspective view of a front portion of a sailboat, including a bowsprit according to the principles of the present invention.

Referring to FIG. 1, a sailboat 10 includes a hull 12 with a deck or foredeck 14 as the top surface thereof and from which extends a mast 16 that supports a main sail 18 in conjunction with a boom 20. At the front of the mast 16 is provided a jib sail or jib 22. A stay cable or forestay 24 is connected between a point at or near the top of the mast 16 and the foredeck 14.

In the preferred embodiment, a bowsprit 26 is mounted on the sailboat 10 extending from the mast 16 through a mounting bracket 28 for the forestay cable 24. The bowsprit 26 shown in FIG. 1 is in its retracted position and, in one embodiment of the invention, extends no farther than the bow 30 of the boat when in the retracted position.

The bowsprit 26 is connected to the mast 16 by a clip or snap-shackle 32 as with a conventional spinnaker pole. The snap-shackle 32 permits the bowsprit to easily be removed from the foredeck when not in use. Also, the snap-shackle 32 permits the inboard end of the bowsprit adjacent to the mast to be released and reconnected to a different location on the foredeck 14 such as at a fastening member 34. Two or more such fastening members may be provided on the foredeck 14 at symmetrical locations to permit the inboard end of the bowsprit 26 to be connected at symmetrical angles either on port or starboard portions of the foredeck.

Alternatively, in a preferred embodiment, the inboard end of the bowsprit may be attached to a partially circular track mounted on the foredeck 14 in front of the mast, so that the inboard end of the bowsprit may be easily adjusted under load to change the angle of the bowsprit and spinnaker sail in relation to the centerline of the boat. Either method of adjusting the inboard attachment of the bowsprit permits the boat to sail at a deeper angle (more downwind) of up to approximately 20° to 25° more than is possible with a fixed or retractable bowsprit mounted into the hull of the boat. To accommodate these changes in bowsprit angles, the bracket 28 swivels, as will be described later. The bracket 28 includes a bridle ring 36 that connects the forestay 24 to the foredeck 14 through the bracket 28.

Figures 2, 9:
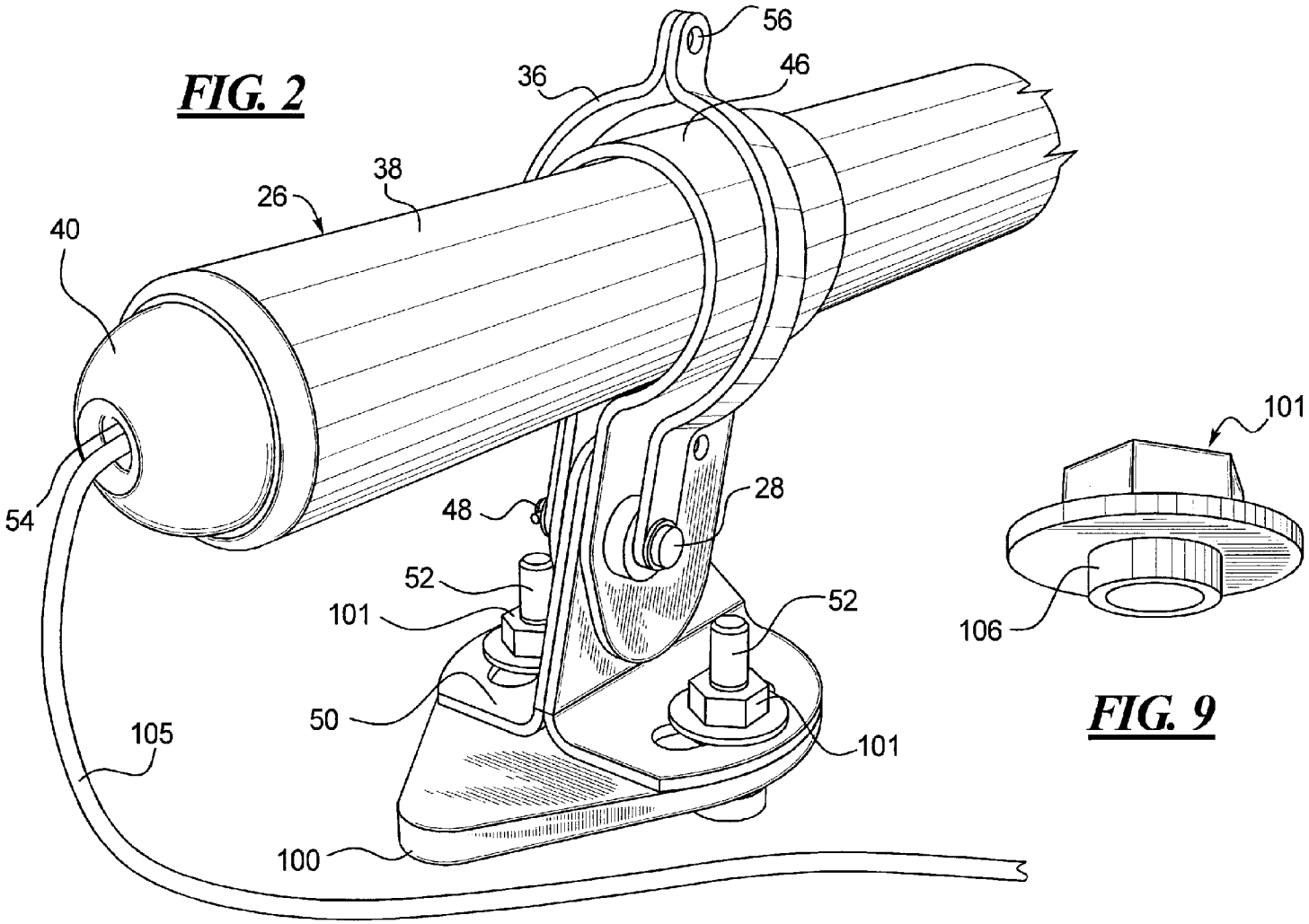
FIG. 2 is a perspective view of a front end of the present bowsprit in a retracted position.
FIG. 9 is a perspective view of a specially designed nut for affixing the rotatable bowsprit bracket to the foredeck.

Turning now to FIG. 2, the bowsprit 26 includes an outer sleeve 38 and an inner telescoping extension or pole 40 which is shown in FIG. 1 and FIG. 2 in its retracted position. The bridle 36 is in the form of a split ring which is mounted to the swivel.

The bowsprit 26 has the outer sleeve 38 passing through a collar 46 of the bracket 28. The sleeve 38 may slide in the collar 46 so as to allow the bowsprit to be moved to a position that extends outward from the bow of the boat. The ring 46 is mounted by a pivot 48 to a base 50 that connects to the foredeck 14 through a teardrop shaped deck mounting plate 100. The pivot 48 permits the collar 46 to tilt at various angles. This enables the bowsprit 26 to be tilted at different angles during release of the latch 32 at the mast and allows positioning of the bowsprit at other positions on the boat 10. The pivot 48 also holds the two curved sections making up the bridle ring 36 to the base 50 in a pivotable manner. The split bridle ring 36 is independently pivotable about the pivot member 48 so that changes in the angle of the bridle ring 36 does not affect the forestay nor does it affect the collar 46 of the bowsprit 26. Similarly, changing the angle of the bowsprit and thus the angle of the collar 46 does not affect the angle of the forestay 24 or exert any significant force on the forestay 24 that is supported on the bridle ring 36.

The base 50 is attached to the mounting plate 100 on the foredeck 14 by a pair of mounting bolts 52. When it is in a retracted position, the outer sleeve 38 encloses the entire inner pole 40 except for its end cap. The inner pole 40 has a central bore 54 in its end cap through which a rope or tack line 105 extends for supporting the tack or forward corner of the spinnaker sail.

The bowsprit 26 is mounted on the boat by sliding the outer sleeve 38 through the collar 46, and connecting the snap shackle 32 to the mast. The bowsprit 26 may be extended by adjusting the inner extendable pole 40 outward from the outer sleeve 38 to support the tack of the spinnaker sail forward and outboard of the bow 30.

The top of the two bridle ring parts 36 have holes 56 for connection of the jib forestay 24.

Figure 3:
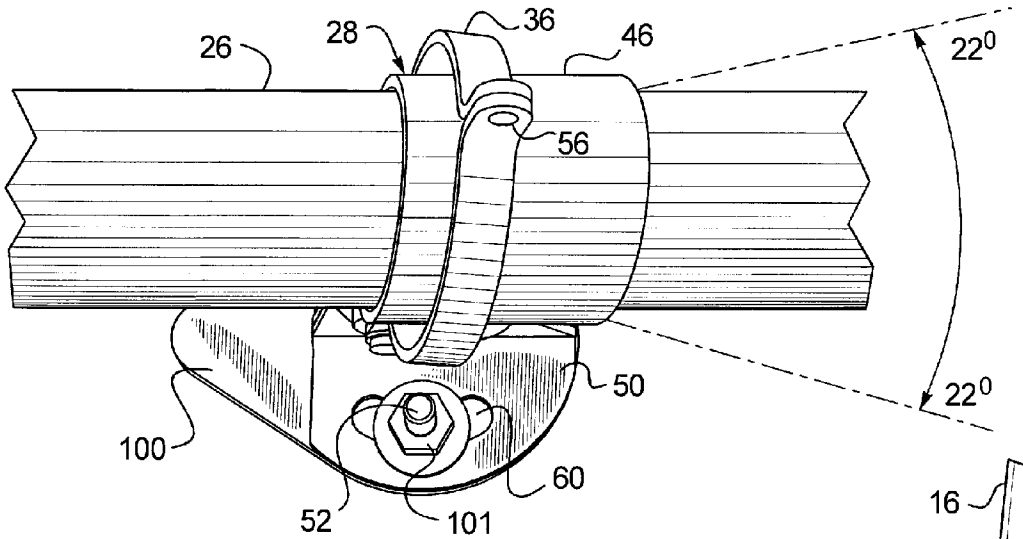
FIG. 3 is a top view of a front portion of the bowsprit including a mounting bracket.

Turning now to FIG. 3, the two halves of the bridle ring 36 with the forestay mounting holes 56 at the top thereof extend around the sleeve 46. The base 50 that supports the bridle ring 36 and sleeve 46 includes arcuate slots 60 through which the deck mounting bolts 52 extend. The deck mounting nuts 101 are tightened down on the bolts 52. Because the deck mounting nuts 101 have collars 106 (as shown in FIG. 9) that are slightly thicker than the thickness of the base plate 50, they do not clamp the base plate tight to the mounting plate 100. The collared nuts 101 therefore permit the collar 46 and bridle ring 36 to rotate about a vertical axis by sliding movement of base plate 50 about the bolts 52 in the arcuate slots 60. This rotation permits the bowsprit 26 to pivot by approximately 22° to 25° in either direction, as indicated by the broken lines in FIG. 3. The addition of the bridle ring 36 to accomplish passing through the forestay introduces an additional component that could fail and cause the rig (or mast) to collapse. Each side of the split bridle ring 36 is designed strong enough to hold the forestay in the event of one side fracturing. Although the use of a split bridle ring as opposed to a single continuous ring is not required, it does eliminate a single point of failure. It is foreseeable in some circumstances to provide a single piece bridle ring, which is within the scope of the present invention.

Figure 4:
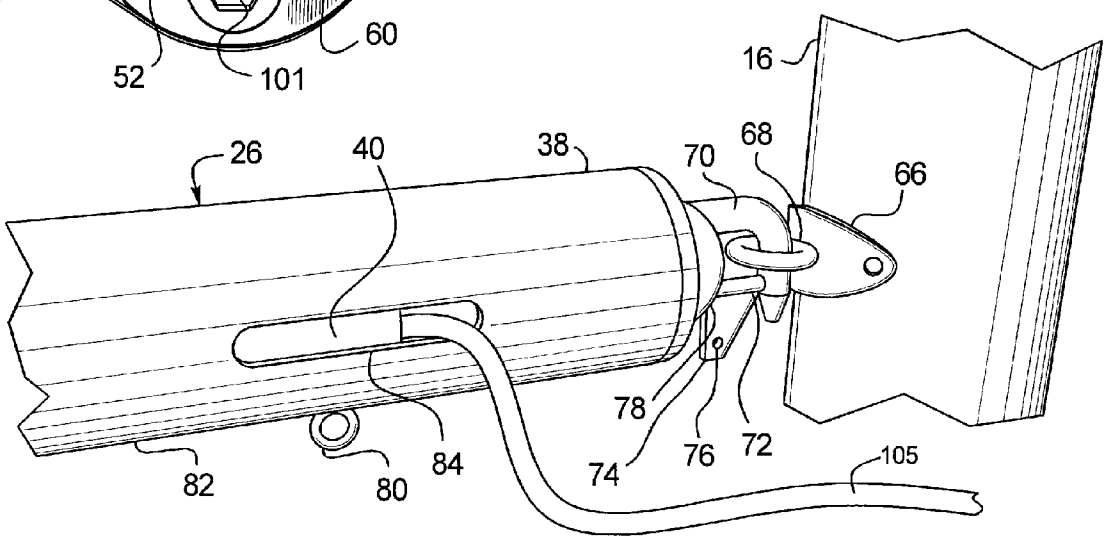
FIG. 4 is a side view of the aft end of the present bowsprit.
Figure 12:
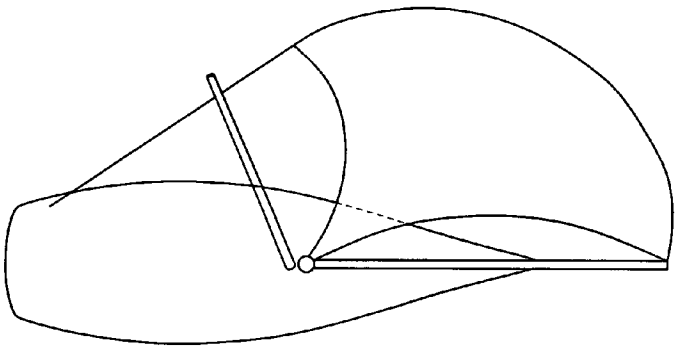
FIG. 12 is a overhead view of an asymmetrical spinnaker flying from a bowsprit projecting from the bow.
Figure 11:
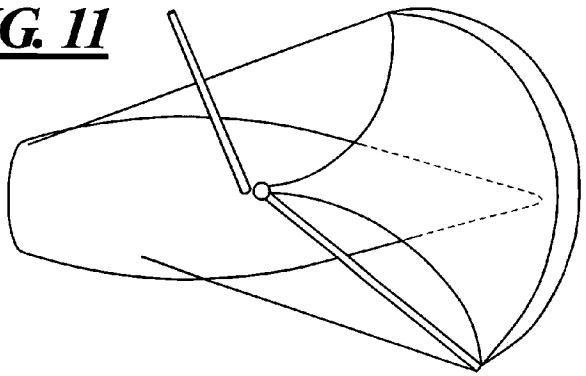
FIG. 11 is a overhead view of a conventional symmetrical spinnaker flying from a spinnaker pole attached to the mast.

With reference to FIG. 4, the aft end of the bowsprit 26 connects to the mast 16 by a standard mast fitting or pad-eye 66 having a ring 68 extending therefrom. Mounted in this aft end of the spinnaker pole 26 and fitted in to the outer sleeve 38 is a standard spinnaker pole jaw end fitting 78 which is readily available from many marine part suppliers. This standard jaw fitting 78 has a hook 70 which extends from the end of the bowsprit 26 and through the opening 68 in the pad-eye 66. A spring-loaded retractable clasp member 72 extends from the jaw 78 and into engagement with the hook 70 to prevent release of the hook 70 from the ring 68. The retractable clasp 72 has a flag extension 74 which may be grasped by a user to retract the latch 72 toward the end of the bowsprit 26 sufficiently to permit removal of the hook 70 from the ring 68. The flag 74 has a hole 76 formed therein through which a cord or lanyard may be attached so that the latch 72 may be easily operated by a crew member leaning forward from the cockpit, for example.

It is contemplated that the aft end of the bowsprit may be fastened to position not on the mast. For instance, a mounting member may be provided on the foredeck to which the aft end of the sprit is connected. Such mounting member may be forward of the mast or to one side or the other, depending on mast position and bowsprit and foredeck length.

Figures 8, 10:
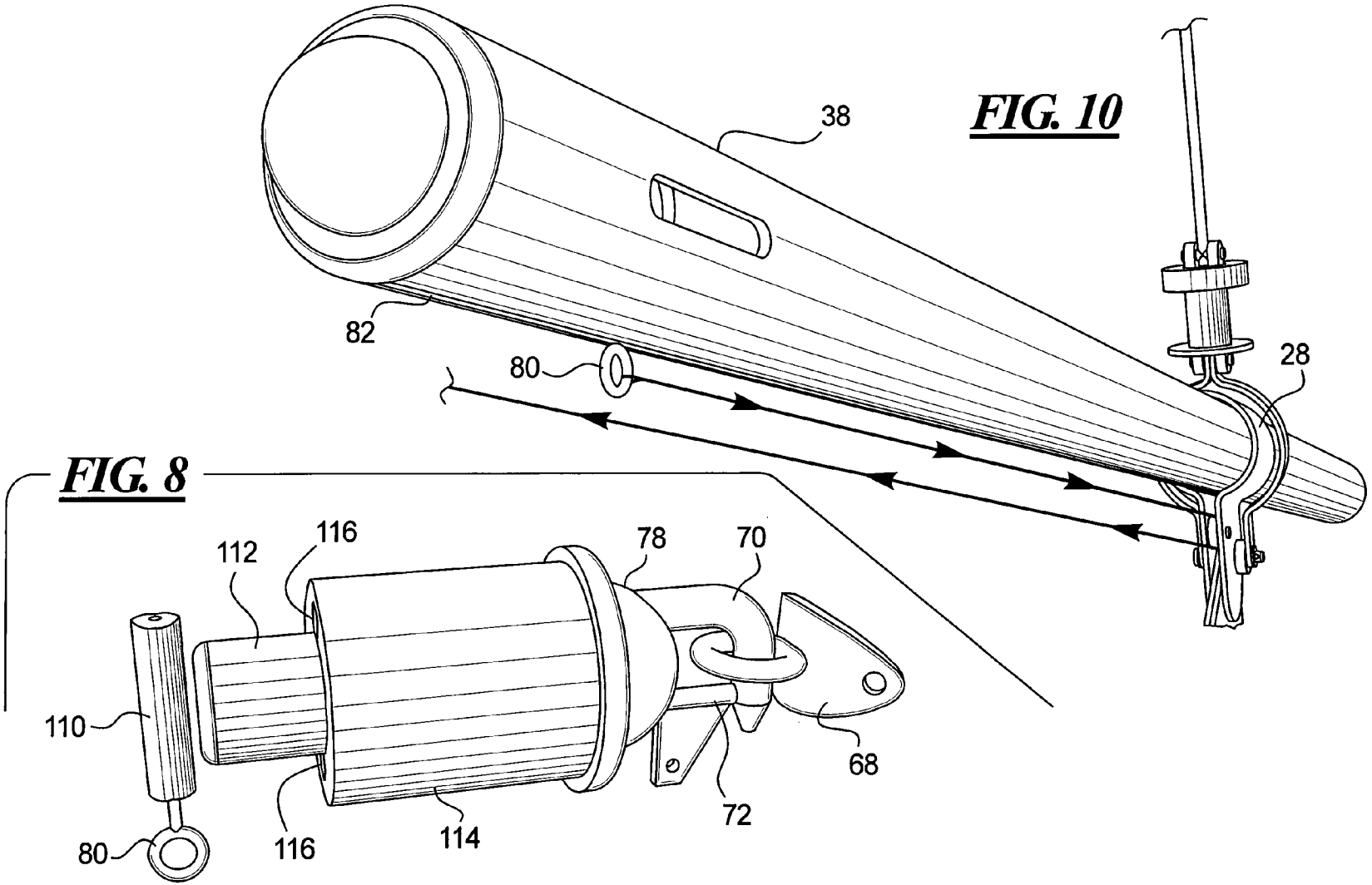
FIG. 8 is a side view of a cleat for affixing the end of the bowsprit to the mast.
FIG. 10 is an inverted view of the bowsprit showing the bowsprit puller line.

The outer sleeve 38 is hollow so that the extendable inner pole 40 may fit therein. The aft end of the inner pole 40 is connected to a ring 80 that extends from a slot 82 in the sleeve 38. The inner pole 40 may be extended by engaging the ring 80 and moving it forward along the slot 82 in the direction of the bracket 28. As illustrated in FIG. 10, a line is tied to the ring 80 and pulled upon to move the ring and the inner extendable pole 40 within the outer sleeve 38.

The rope, or tack line 105, normally attached to the forward corner or tack of the asymmetric sail, returns from the opening 54 in the end of the inner pole 40 of the bowsprit shown in FIG. 2 and extends inside and along the length of the inner pole 40 and out of the side of the outer sleeve 38 through an opening or slot 84 formed therein and shown in FIG. 4.

Figure 5:
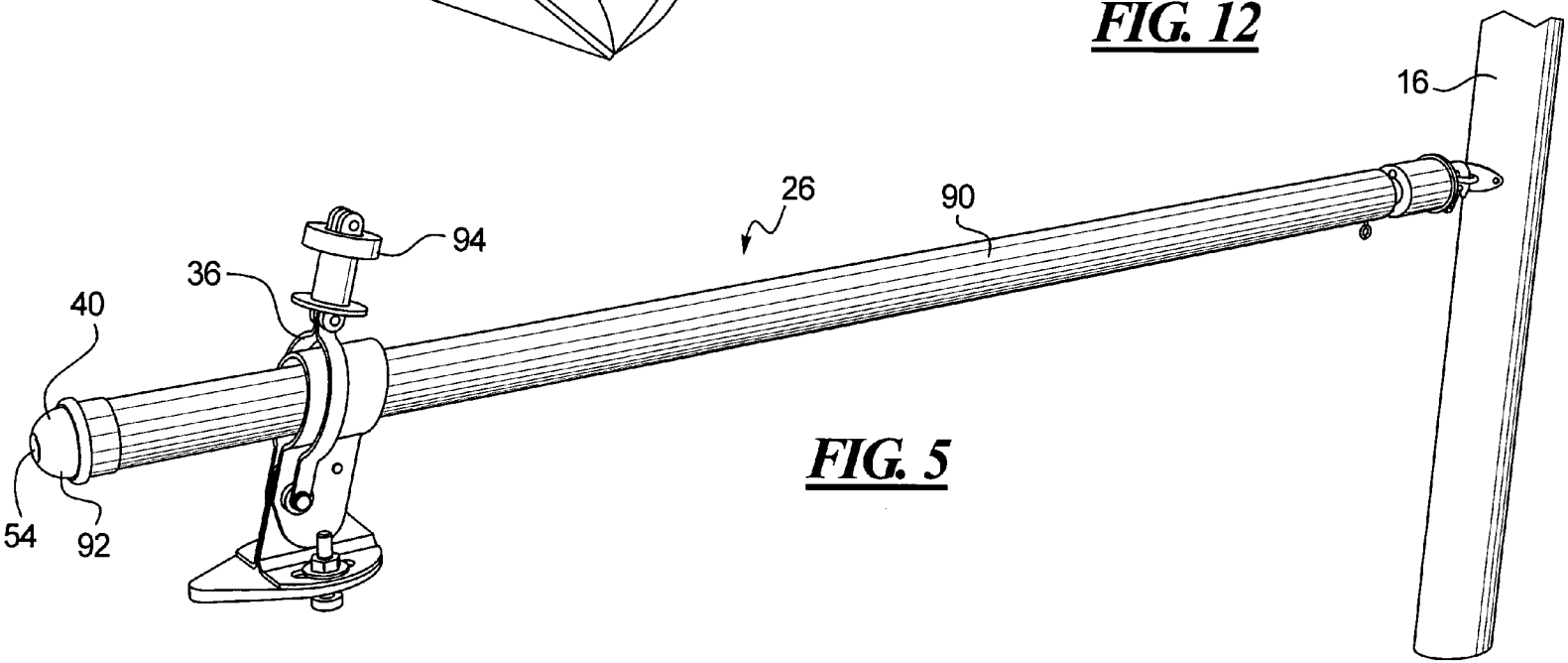
FIG. 5 is a side view of an inner telescoping portion of the bowsprit shown with the outer sleeve removed.

Turning to FIG. 5, the bowsprit 26 is shown with the outer sleeve 38 removed to reveal the inner pole 40. The inner pole 40 is formed by an elongated shaft 90 that is slightly shorter than the outer sleeve 38 to allow for insertion of the spinnaker jaw end fitting 78, although it may be longer or shorter as needed. The inner extendable pole 40 also has an end cap 92 mounted at the end of the shaft 90, the end cap 92 has a hole 54 in its center through which the tack line 105 passes. The end cap 92 is preferably of a durable yet slippery plastic material such as Delrin to enable the tack line to slip easily through the opening 54 without wear. A standard roller furling fitting 94 is mounted on the top of the bridle ring 36 to allow the jib to be furled or unfurled easily from the cockpit of the sailboat.

Figure 6:
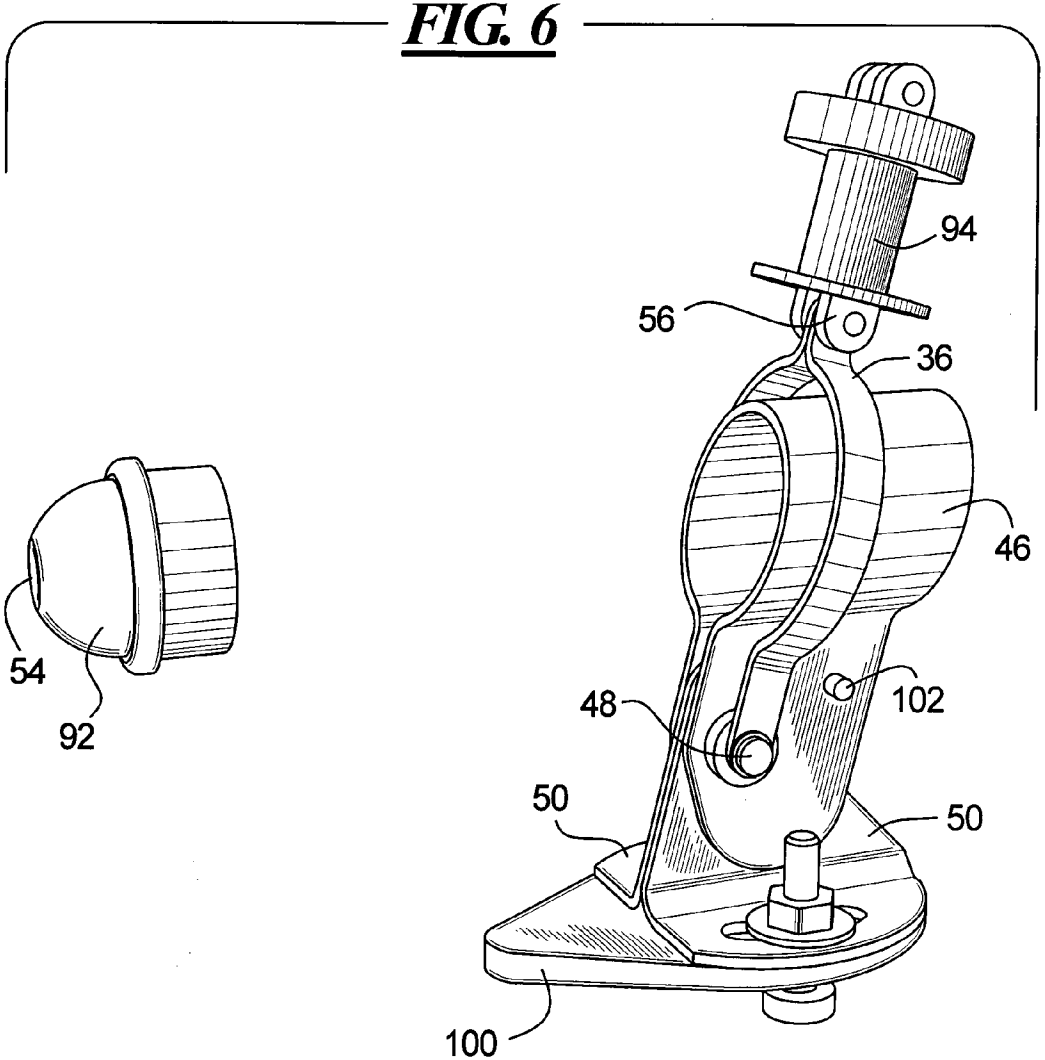
FIG. 6 is a side view of the mounting bracket and end cap for the bowsprit.

In FIG. 6, the roller furling fitting 94 is seen in greater detail and is connected to the two bridle ring parts 36 by a connecting bolt or clevis pin passing through the holes 56. The end cap 92 with the hole 54 therein is shown without the inner extendable member 40. The collar 46 shown in side view has the pivot member 48 connecting the collar 46 to the base 50 and also connecting the bridle ring 36 to the base 50. The base 50 is mounted on a mounting plate 100 that rests atop the foredeck 14 of the sailboat.

The collar 46 has a second pivot point 102 supporting a pulley 104 around which the bowsprit puller line passes.

Figure 7:
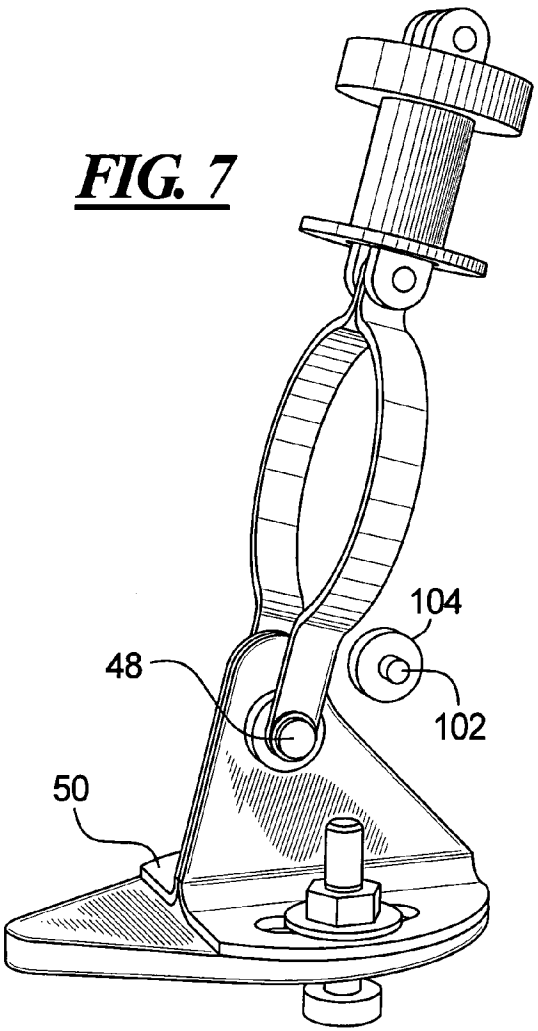
FIG. 7 is a side view of a collar mounting which surrounds the bowsprit bracket.

In FIG. 7, the base plate 100 below the base member 50 has a teardrop shape, although this shape is not required. The base member 50 extends in a generally triangular shape vertically from the base plate 100 to the pivot 48. The second pivot 102 passes through a pulley 104 that is ordinarily concealed within the collar 46 but which is revealed in this view by removal of the collar 46 shown in FIG. 6. Referring to both FIG. 4 and FIG. 10, the pulley 104 permits a line which has been connected to the ring 80 to wrap around the pulley and return to a position to the side of the mast where it may be pulled, or released by a crew member to extend or retract the inner pole 40 of the bowsprit. Pulling on this line causes the pulley 104 to rotate and slides the ring 80 along the slot 82 to cause the inner pole 40 to extend outward from the end of the outer sleeve 38. The bowsprit 26 is thereby extended. The puller line is then secured in position, such as by securing to a cleat on the sailboat deck, so as to maintain the bowsprit 26 in the extended position. A locking or latching mechanism may be provided in this position to further maintain the extended position of the bowsprit. Retraction of the bowsprit 26 is accomplished by releasing the puller line from its deck cleat, for example by releasing the line from the cleat, and permitting the line to reverse its travel around the pulley 48. The crew member who extends or retracts the bowsprit 26 need only move forward to the front of the cockpit near the mast and need not move to the foredeck. If a latch or locking mechanism is provided, it is released as well to permit the retraction of the bowsprit.

Referring now to FIG. 8, the ring 80 that extends through a slot in the outer sleeve is connected to a ring base 110 that is fitted in the end of the inner extendable pole 40. The ring anchor 110 strikes a rubber stopper 112 when the extendable inner pole 40 is in the full retracted position. The rubber stopper 112 acts as a shock absorber, and is mounted on the end of a plug 114 that is fitted into the end of the outer sleeve 38 and which supports the hook 70 and latch 72. The rubber stopper 112 or other shock absorber, prevents damage to the bowsprit components and to the mast and other sailboat components should the crew inadvertently loose grip of the puller line and allow the inner pole to move rapidly back to its retracted position. The plug 114 has openings 116 in which two strong elastic bands or bungee cords are fastened. The other ends of the two bungee cords are fastened into the end fitting in the outboard end of the extendable pole 40. The use of two bungee cords is not required, but eliminates the single point of failure when using only one bungee. Thus, the extendable member is under tension to return to its retracted position, and will automatically retract as a crew member eases tension on the puller line.

In operation, the bungee cords maintain the inner pole 40 in the retracted position and only by pulling on the cord attached to the ring 80 that runs around the pulley 104 is the inner pole 40 extended. The cord is then run through a jam cleat near the base of the mast 16 or otherwise fastened to hold the extended member in its extended position. In the extended position, the tack line running inside the inner retractable pole 40 and out through the hole 54 in the end cap 92 supports the spinnaker sail. By unclasping the hook 70 from the ring 68 on the mast and fastening the hook 70 into a fastening means 34 or on a similar fixing mounted on a partial circular track on the foredeck 14 of the boat, the angular position of the bowsprit and thus the position of the spinnaker can be changed.

The use of bungee cords or other elastic bands for retracting the inner pole 40 into the outer pole 38 is preferred, but other means of retracting the inner pole 40 into the outer pole 38 are possible, including springs, rubber or elastic straps, a retracting line or rope that is pulled counter to the puller line that extends the inner pole, and other comparable means.

By utilization of the bridle ring 36, the bowsprit can be centered on the boat and need not be placed to the side of the forestay. The present bowsprit can be added to existing boats easily with little modification of the boat and without cutting holes into the outer hull for the bowsprit to pass through. The crew does not have to go to the foredeck of the boat to jibe the spinnaker.

The outer and inner shafts of the bowsprit are formed of strong and lightweight materials and in a preferred embodiment are formed of a carbon fiber material. The carbon fiber material must have sufficient coatings to prevent damage from moisture, sun, and salt. It is within the scope of this invention that inner and outer shafts of the bowsprit, as well as other parts of the present bowsprit, may be formed of other materials than those mentioned herein.

It is within the scope of the invention that the bowsprit is extendable by telescoping extension without being slidable through the bridle ring. In another embodiment, the bowsprit may be extendable only by sliding in position through the bridle ring and need not be extendable by telescoping. The preferred embodiment however provides for extension by both telescoping extension and by sliding the bowsprit through the bridle.

The drawings illustrate the bridle of the present invention being connected to a roller furler that is in turn connected to the forestay of the mast. It is within the scope of the invention to provide a direct connection from the bridle to the stay or to provide the connection through a furler or through other components. In some rigging configurations, the luff wire of the sail may be connected to the bridle, either directly or through a component such as a roller furler. For purposes of this invention, such a connection is considered as a connection to the stay. Thus, the term stay includes stay wires, sail luffs and other rigging.

Although other modifications and changes may be suggested by those skilled in the art, it is the intention of the inventors to embody within the patent warranted hereon all changes and modifications as reasonably and properly come within the scope of their contribution to the art.

I claim:

1. A bowsprit for a sailboat, comprising:

a base adapted for mounting on a deck of the sailboat;

a collar mounted to said base;

a stay connected to said collar;

an outer elongated tubular member extending through said collar, said outer elongated tubular member having an end adapted for fastening to a mounting position on the sailboat;

an inner elongated tubular member in said outer elongated tubular member;

a line running through said inner elongated tubular member and extending from an end of said inner elongated tubular member, said line being adapted for attachment to a sail;

a connection to said inner elongated tubular member, said connection being operable from outside said outer elongated tubular member to move said inner elongated tubular member within said outer elongated tubular member between a retracted position and an extended position.

2. A bowsprit as claimed in claim 1, further comprising:

a biasing member connected between said inner elongated tubular member and said outer elongated tubular member to bias said inner elongated tubular member in said retracted position.

3. A bowsprit as claimed in claim 1, further comprising:

an end cap mounted in said end of said inner elongated tubular member, said end cap defining an opening through which said line extends.

4. A bowsprit as claimed in claim 1, wherein said collar includes a bridle ring connected to said base for connection to said stay, said inner and outer extended tubular members extending through said bridle ring.

5. A bowsprit as claimed in claim 4, wherein said bridle ring is formed in two pieces, each of said pieces extending from said base to said stay.

6. A bowsprit as claimed in claim 1, wherein said collar is connected to said base by a rotatable connection.

7. A bowsprit as claimed in claim 6, wherein said rotatable connection is rotatable about two axes.

8. A bowsprit as claimed in claim 1, wherein said mounting position for said outer elongated tubular member is on a mast of said sailboat.

9. A bowsprit as claimed in claim 1, further comprising:

a mounting plate adapted for mounting on a deck of a sailboat, said mounting plate being mounted to said base by a rotatable connection.

10. A bowsprit as claimed in claim 1, further comprising:

a releasable connector at said end of said outer elongated tubular member, said releasable connector having a first portion affixed to said end of said outer elongated tubular member and a second portion adapted for mounting to said mounting position of the sailboat.

11. A bowsprit as claimed in claim 1, further comprising:

a further connector adapted for mounting on the sailboat at a position spaced from said mounting position, said further connector being connectable to said first portion of said releasable connector at said end of said elongated tubular member.

12. A bowsprit as claimed in claim 1, wherein said connection to said inner elongated tubular member includes a connection member extending transversely from said inner elongated tubular member, said connection member extending through a slot in said outer elongated tubular member and being movable along said slot during movement of said inner elongated tubular member between said retracted position and said extended position.

13. A bowsprit as claimed in claim 1, further comprising:

a pulley mounted at said collar; and a draw cord extending over said pulley and connected to said connection.

14. A bowsprit as claimed in claim 1, wherein said outer elongated tubular member is slidably mounted in said collar.

* * * * *